US005908014A

United States Patent [19]

Leithinger

[11] Patent Number: 5,908,014

[45] Date of Patent: Jun. 1, 1999

[54] RECIPROCATING PISTON TYPE INTERNAL COMBUSTION ENGINE WITH VARIABLE COMPRESSION RATIO

[75] Inventor: Siegfried Franz Leithinger, Richterswil, Switzerland

[73] Assignee: TK Design AG, Vaduz, Liechtenstein

[21] Appl. No.: 08/913,164

[22] PCT Filed: Feb. 28, 1996

[86] PCT No.: PCT/CH96/00062

§ 371 Date: Aug. 20, 1997

§ 102(e) Date: Aug. 20, 1997

[87] PCT Pub. No.: WO96/27079

PCT Pub. Date: Sep. 6, 1996

[30] Foreign Application Priority Data

Feb. 28, 1995 [CH] Switzerland ..... 566/95

[51] Int. Cl.[6] ..... G05G 1/00

[52] U.S. Cl. ..... 123/78 F; 123/48 B

[58] Field of Search ..... 123/78 F, 78 BA, 123/78 E, 48 B, 197.4

[56] References Cited

U.S. PATENT DOCUMENTS

| | | | |
|---|---|---|---|
| 1,553,009 | 9/1925 | Stuke | 123/78 F |
| 4,044,629 | 8/1977 | Clarke | 123/78 BA |
| 5,158,047 | 10/1992 | Schaal et al. | 123/78 BA |

*Primary Examiner*—Marguerite McMahon
*Attorney, Agent, or Firm*—Edwin D. Schindler

[57] ABSTRACT

The compression ratio is variable in that the piston hub may be adjusted, since the connecting rod is mounted at the crankshaft side on an eccentric pin. The eccentric crank pin can be adjusted around its axis of rotation by control means while the engine is running. The control means include a toothed wheel that turns concentrically to the axis of rotation of the eccentric crank pin and is fixed thereto. This toothed wheel acts as an external gear inside a larger diameter internal gear inside which it rolls. The internal gear is concentrically mounted around the axis of the crankshaft and its rotating position may be adjusted. The external gear turns exactly once upon itself every time it rolls round the internal gear.

10 Claims, 11 Drawing Sheets a)

b)

Figure 1:
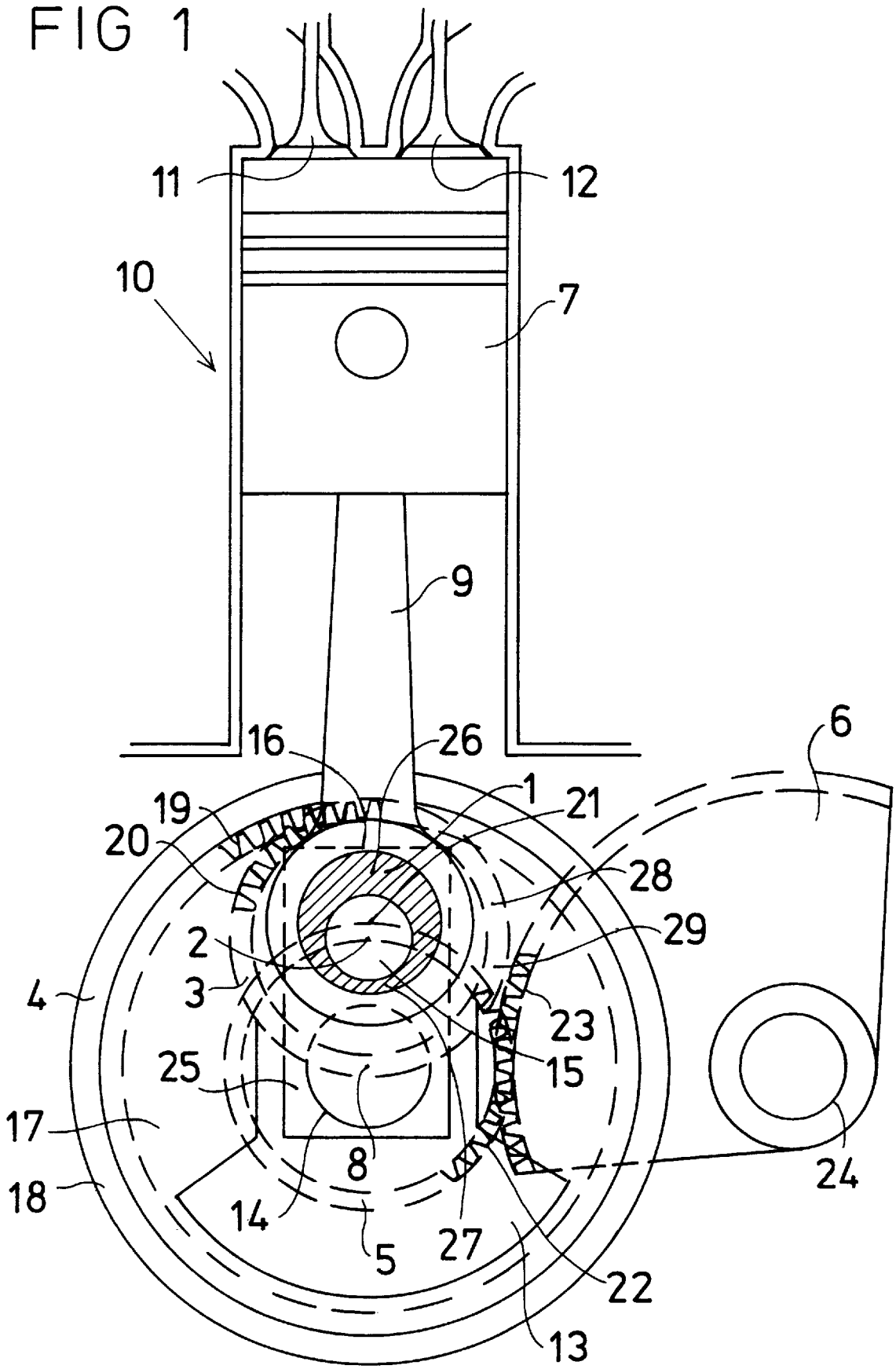

RECIPROCATING PISTON TYPE INTERNAL COMBUSTION ENGINE WITH VARIABLE COMPRESSION RATIO

This invention relates to a reciprocating piston type internal combustion engine with a variable compression ratio according to the preamble of the patent claim. The great majority of internal combustion engines in use today are reciprocating piston type engines. In a reciprocating piston engine of this type, the compression ratio is the ratio between the combustion space that remains free when the piston is at the top dead-centre and the total cylinder volume when the piston is at the bottom dead-centre. The combustion processes in such reciprocating piston engines and in internal combustion engines in general are very complex and are influenced by several parameters. This is just as true of petrol engines as it is of diesel engines or indeed engines which run on other types of fuels. Optimum fuel combustion and hence maximum engine efficiency basically depend on the volume of air sucked or taken in, its temperature, humidity and compression, on the type and quality of the fuel injected into the engine, on the way the fuel mixes with the air and on the ignition of the mixture. Hence the quality of the fuel/air mixture and the precise timing and manner in which it is ignited also affect the movement of the piston. The pressure pattern during combustion also plays a major role, as does the timing of combustion per se. When an engine is running under a high load, the combustion pressures are higher than when it runs idle. If the engine is run at a high speed, there is far less time for combustion than if the engine is allowed to run at a low speed. In addition to these variables, which depend on the way the engine is operated, external climatic conditions also influence the way the engine runs and the efficiency of the combustion. Hence it is not all one and the same whether an engine is operated at sea level or at high altitudes where the air pressure is low. The external temperature and the weather-related air humidity also play a role.

Over the last few years, great advances have been made in relation to optimizing engine combustion processes; these are essentially due to the constantly expanding capabilities of the available microprocessor controls on the one hand, and to the achievements made in the field of materials engineering on the other hand. In many engines, the composition of the fuel/air mixture is now controlled by a microprocessor. The quantity of air sucked in, its temperature and humidity are measured, for example, and the volume of fuel injected is recalculated and optimized for each injection in line with these parameters. Furthermore, the instant of ignition and the timing and duration of the fuel injection are recalculated each time by a microprocessor which also takes the engine speed into account. Improved materials have also made it feasible to use 4-valve technology in engines for everyday use whereas earlier on this costly technology was used exclusively for high performance engines. Improved fuels, i.e. improved grades of petrol in particular, plus better materials allow higher combustion temperatures and pressures and have hence tended to lead to a higher compression coefficient in modern engines in comparison with the past. Compression is also a factor with a crucial impact on the combustion of the fuel/air mixture and hence the efficiency of the engine. As a general rule, the higher the compression ratio, the better the efficiency of combustion. The limit of maximum compression is defined by the knock resistance rating, in that if it is compressed too much, the air/fuel mixture self-ignites and hence uncontrolled combustions occur at the wrong times. The engine then knocks and sustains damage.

All the above-mentioned parameters are involved in a complex interplay. A vehicle engine is driven at constantly changing speeds and under different loads. On top of that there are all the various external factors such as fluctuating air temperature, air pressure and humidity. Hence a conventional engine with a fixed compression ratio can never run ideally or to optimum effect. The engine combustion process can at best be optimized to some degree with respect to one single fixed working point. With variable compression, the combustion processes can be optimized to a greater degree across the engine's entire working range.

This invention is based on the recognition that when combustion processes are optimized, the compression is indeed optimized in respect of a fixed ratio, but no consideration is given to finding a means of variably adapting the compression to the operating conditions. As far as today's engine technology is concerned, the choice of the fixed compression ratio is always a finely selected compromise across the entire range of the engine operating conditions. The higher the compression, the higher the performance density, or specific power output of the engine, but the greater the problem of knock resistance and stress on engine parts, both of which obviously have an impact on the engine's service life.

In the past, there have been a range of proposals for realizing an internal combustion motor with variable compression. Hence the crankshaft is raised in relation to the cylinder, for example, or longitudinally variable cylinders are used. The prior art also includes a system in which the piston length can be varied. Issue April 1985 of the German trade journal 'Automobil-Industrie' reports on a test carried out by Volkswagen in which a VW Golf with a 1.6 liter injection engine was fitted with a variable compression mechanism. This was achieved by means of a secondary combustion chamber disposed in the cylinder head. The volume of this secondary chamber, and hence the compression ratio, was altered using a piston that could be moved inside the secondary chamber so that the compression ratio could be electromechanically varied between $\epsilon=9.5$ and $\epsilon=15.5$ in response to the load on the engine. In the partial load range (ECE urban cycle) fuel savings of up to 12.7% were measured in comparison with the optimized standard engine. Even in a 3-way mix, the fuel saving was still 9.6%. Hence a variable compression is associated with a significant fuel saving potential. Until now, however, the structural cost of variable compression was too high for the concept to be used on standard models. A further disadvantage of the above-mentioned solution with a secondary combustion chamber is also that the combustion chamber does not remain compact at a low compression, which has a negative effect on the combustion processes and exhaust emissions. Another proposal for realizing a variable compression originates from Louis Damblanc from Paris as described in his German Reich patent no. 488'059 of Dec. 5, 1929: an eccentric connecting rod bearing bush positioned on the crank pin can be adjusted from the crankshaft using a differential gear. This differential gear includes a shaft which runs concentrically to the crankshaft on the inside of the crankshaft. An internally toothed gear is driven by the crankshaft and drives three interior satellite toothed gears with diameters approximately three times smaller which are disposed at intervals around its inside periphery and mounted on bolts on a disk acting as a toothed sector, all three of which mesh with a central toothed gear mounted on said shaft that runs through the inside of the crankshaft. The toothed sector can be adjusted via another toothed gear that acts on its periphery. This differential gear is complex, particularly because of the shaft required inside the crankshaft. Whatever the case, this construction for varying the compression ratio never became widely used.

Hence the invention is based on the task of creating an internal combustion engine having a variable compression ratio provided by an eccentric crank pin and which can, therefore, be adapted to the current engine operating conditions and optimized across their entire range, thereby contributing to an overall increase in the efficiency and smooth running of the engine.

This task is solved by a reciprocating piston type internal combustion engine with a variable compression ratio in that the piston hub can be adjusted since the connecting rod is mounted at the crankshaft side on an eccentric crank pin, with the eccentric crank pin being able to be adjusted around its axis of rotation by control means while the engine is running, and which is characterized in that the eccentric crank pin is constituted by at least two shells which are disposed around the crank arm-shaft of the crankshaft so as to enclose it, and in that these shells are each connected to a toothed gear segment, said segments also enclosing the crank arm-shaft of the crankshaft, and in that the toothed gear formed by these segments rolls as an external gear inside a larger diameter internal gear which is concentrically mounted around the axis of the crankshaft and its rotating position may be adjusted such that the external gear turns exactly once upon itself every time it rolls round the internal gear when the latter is stationary.

An example of an embodiment of a reciprocating piston type internal combustion engine according to the invention is illustrated in the Figures; it will be described in detail in the following description and an explanation of the way in which it functions will also be given.

Figure 2:
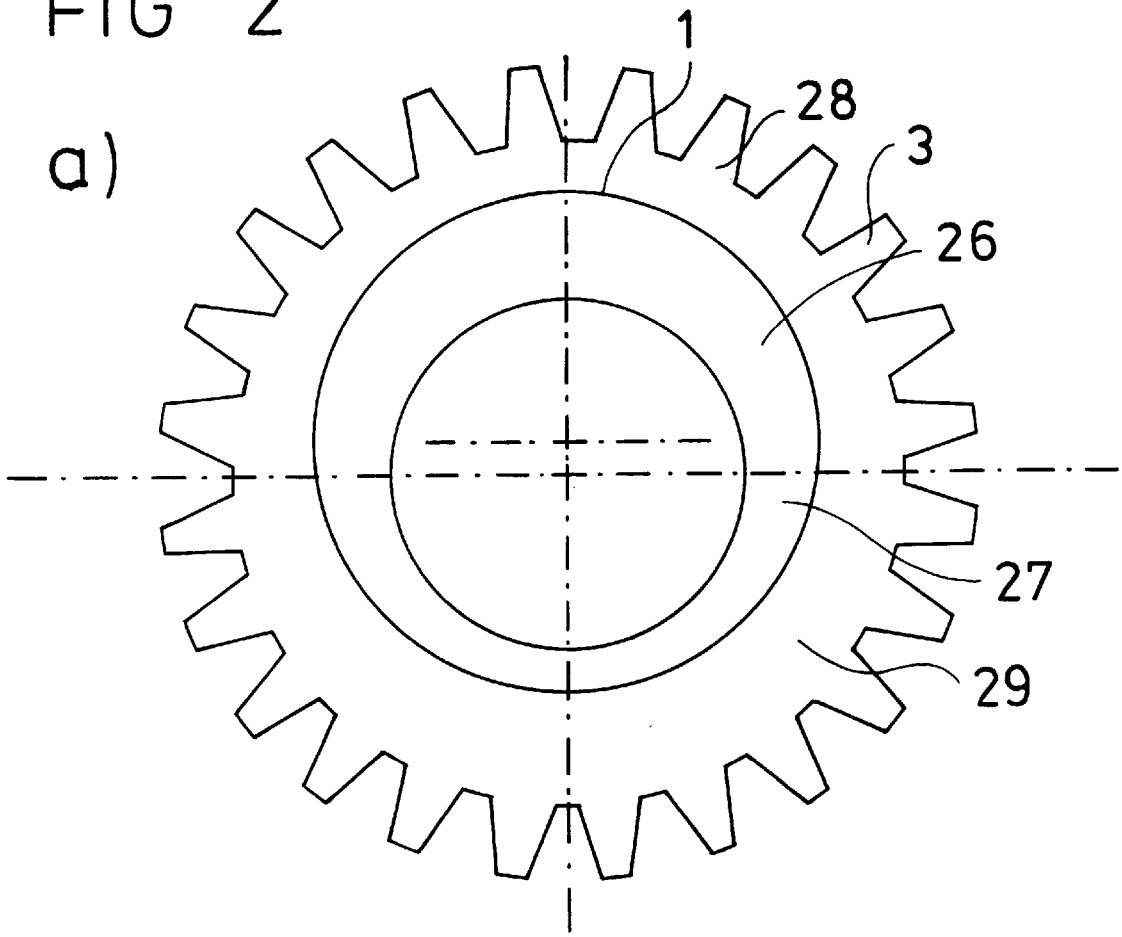
Figure 2:
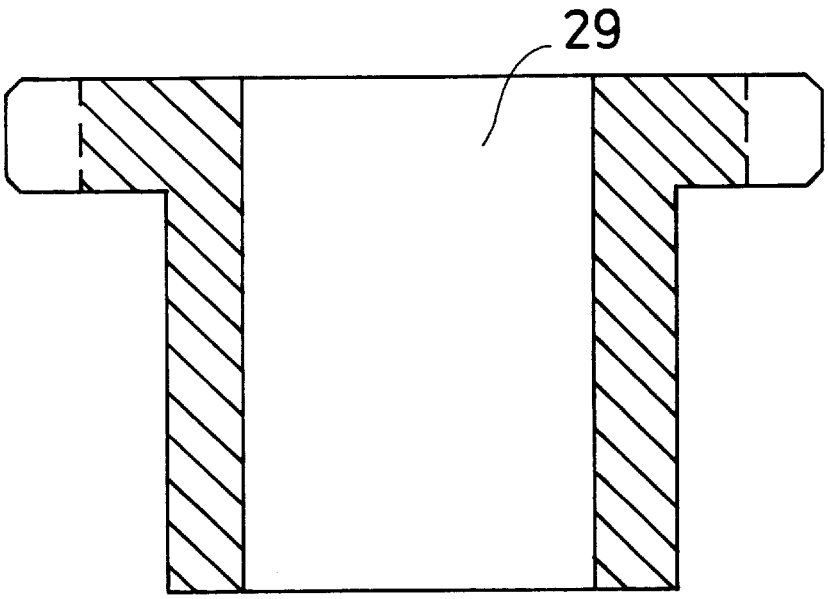
Figure 3:
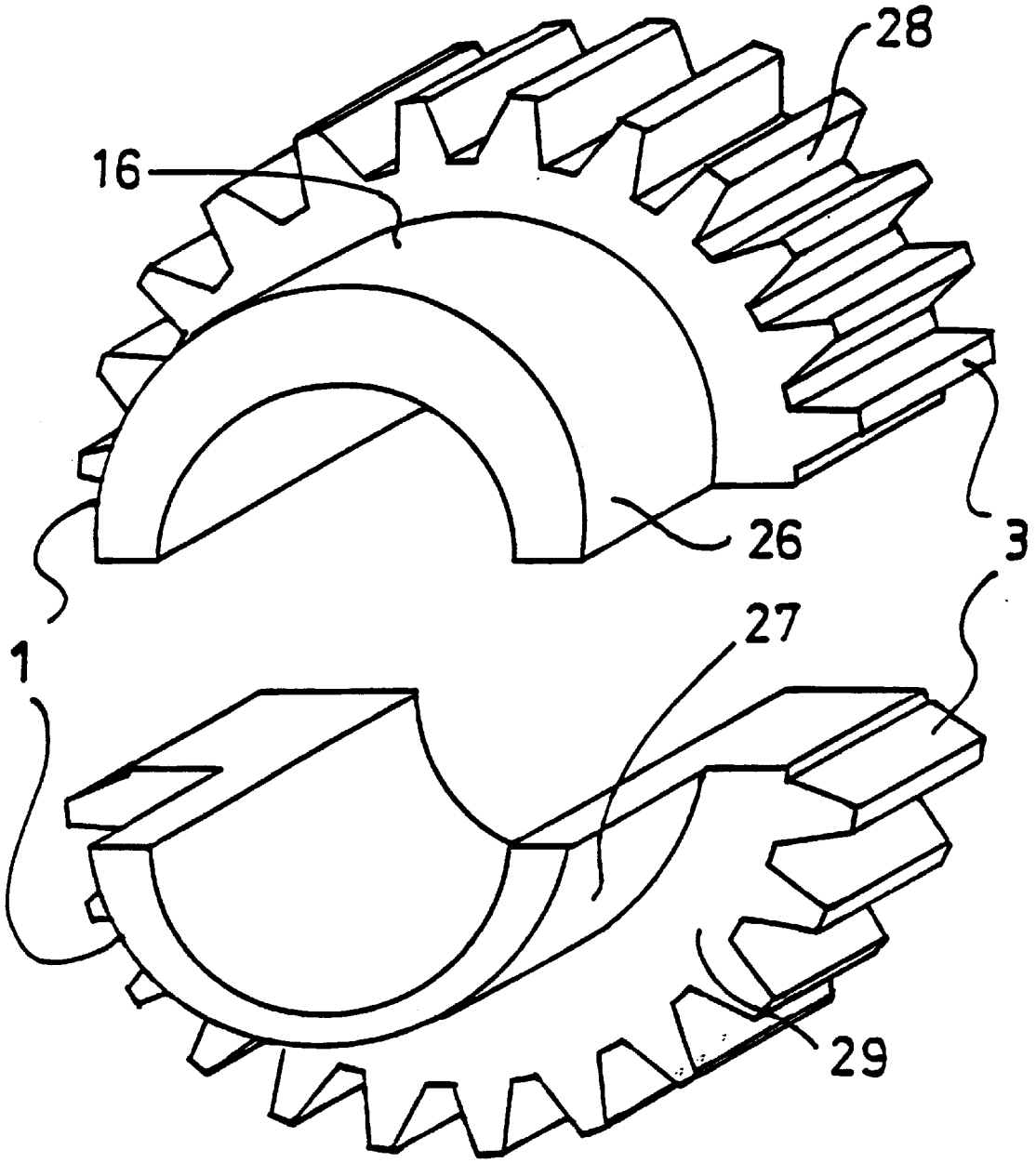
Figure 4:
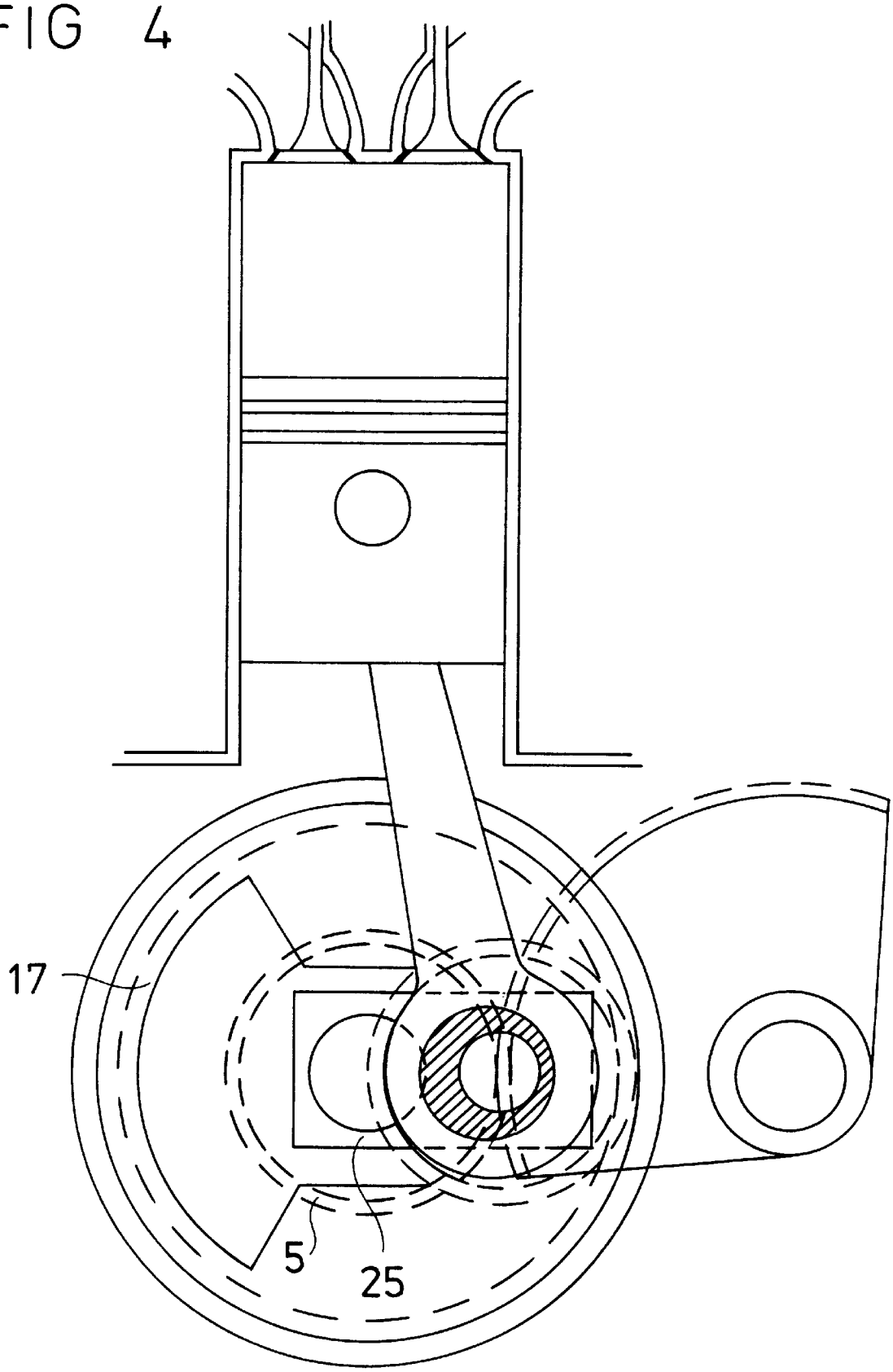
Figure 5:
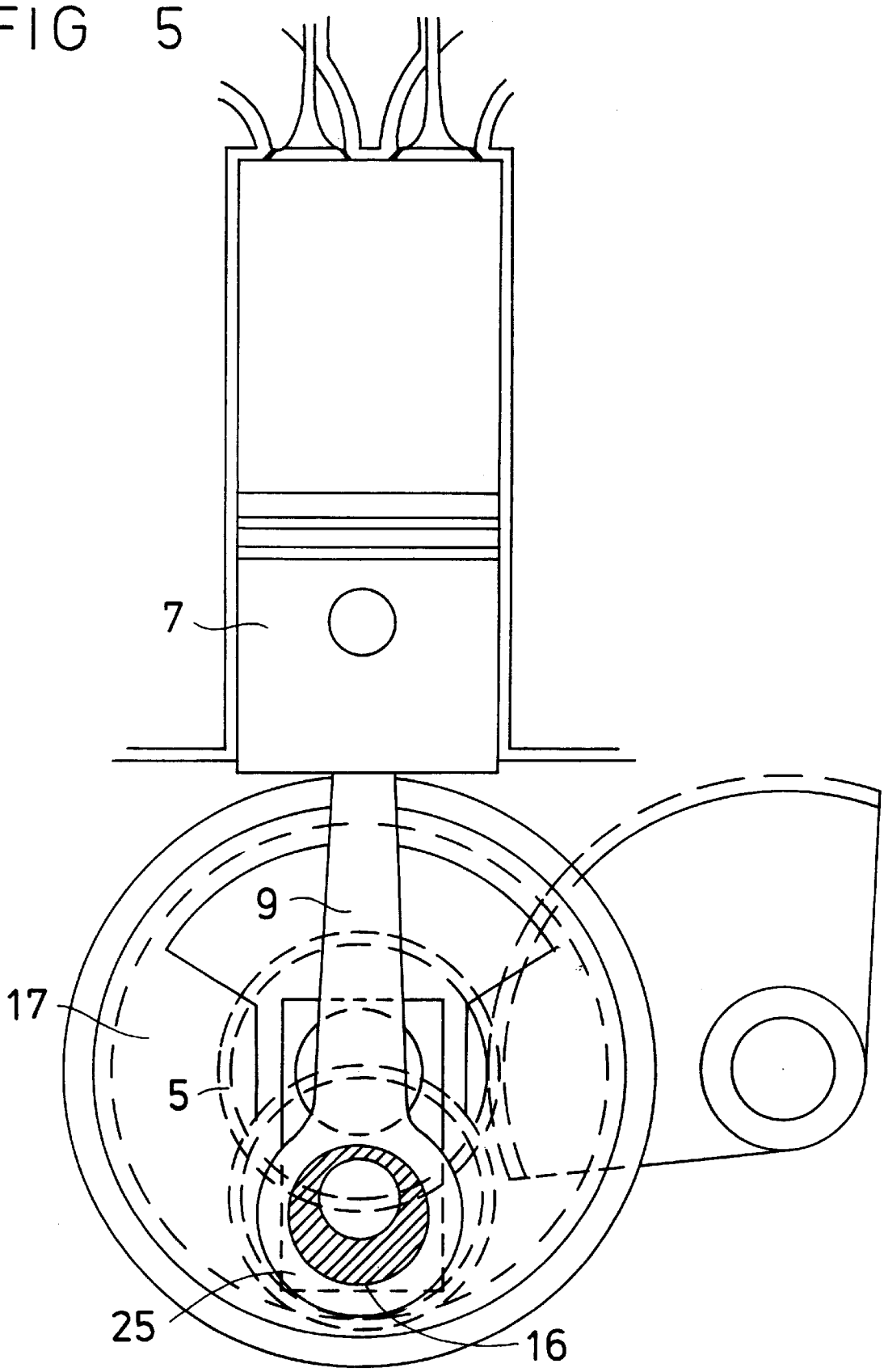
Figure 6:
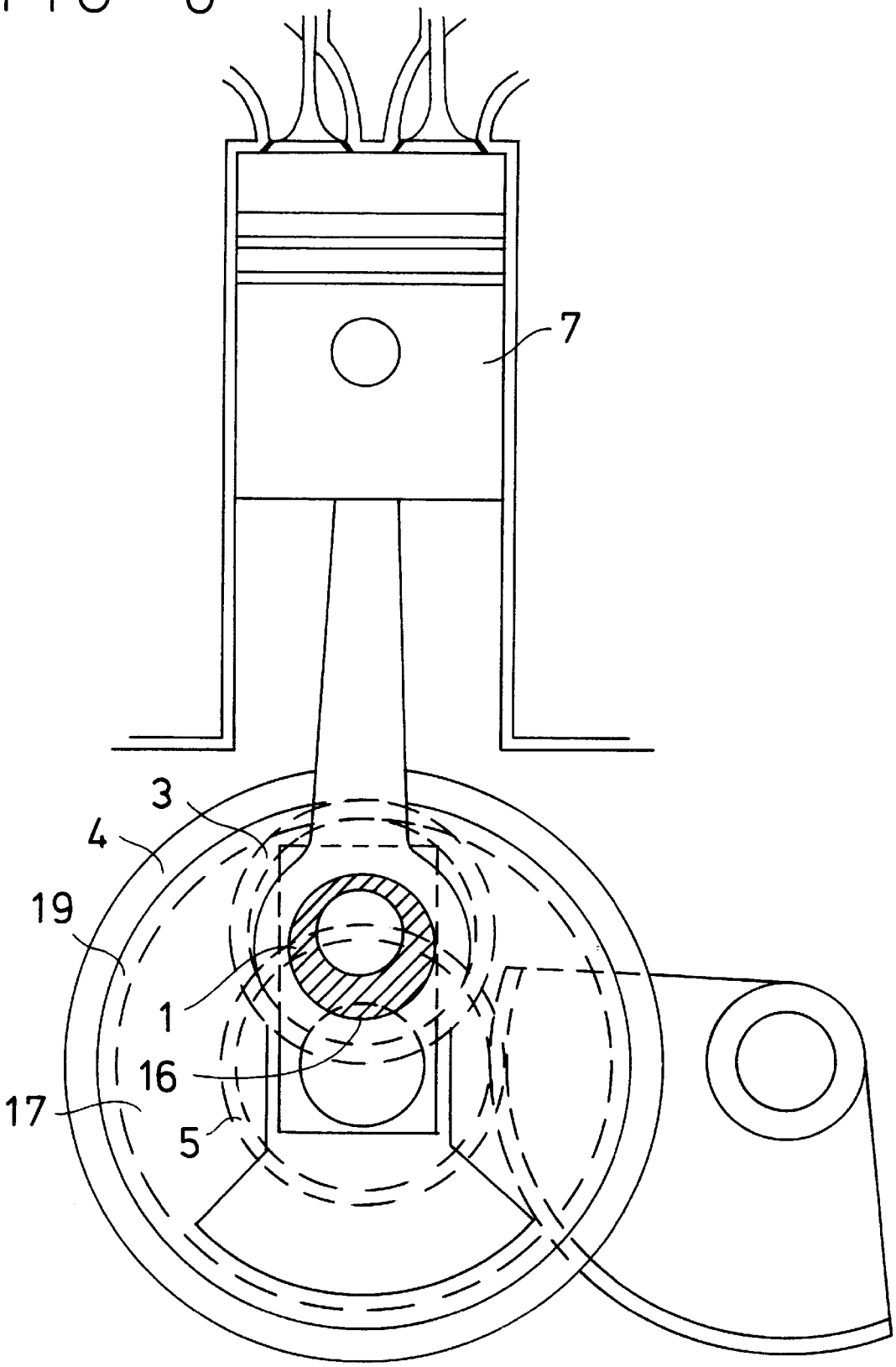
Figure 7:
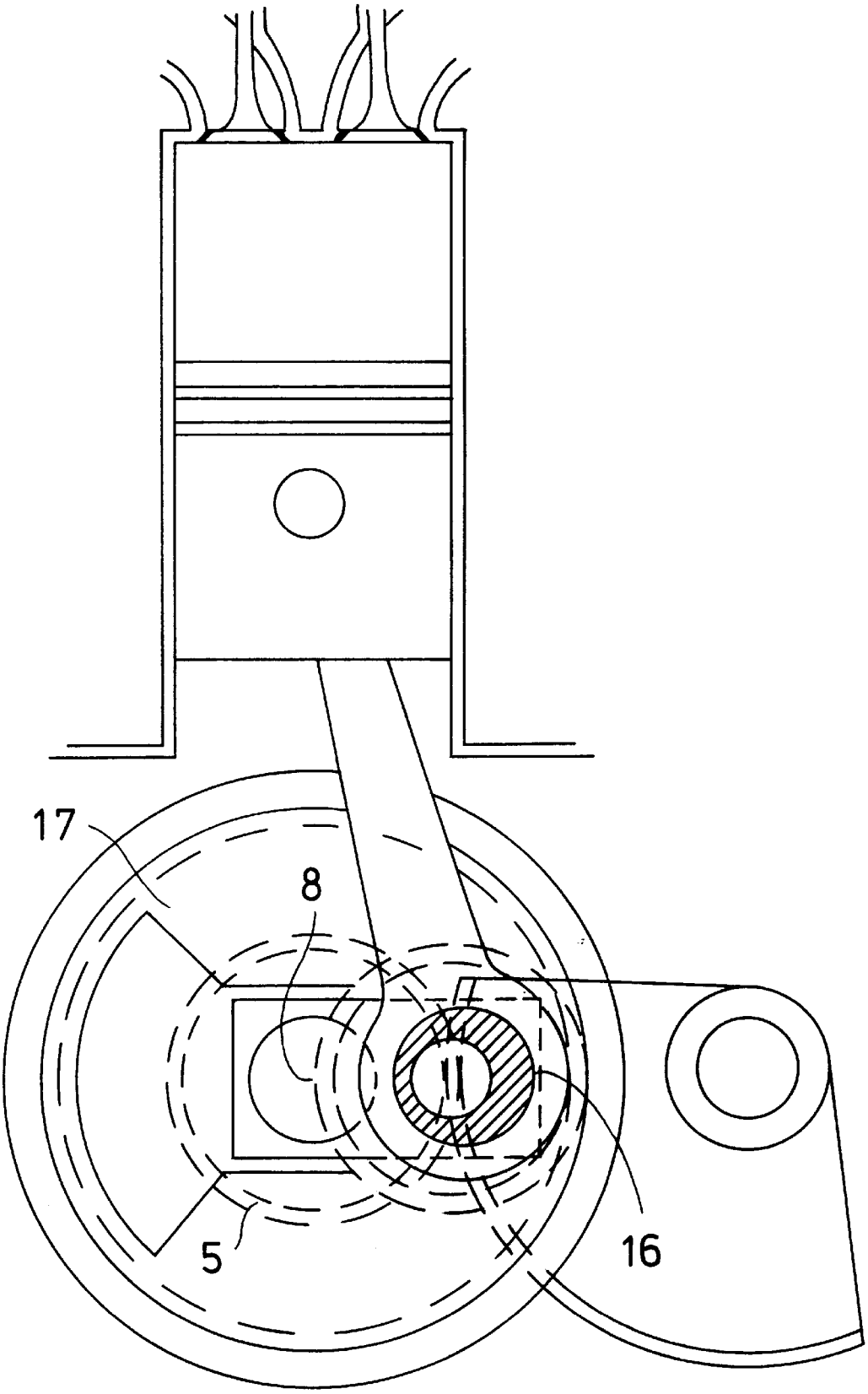
Figure 8:
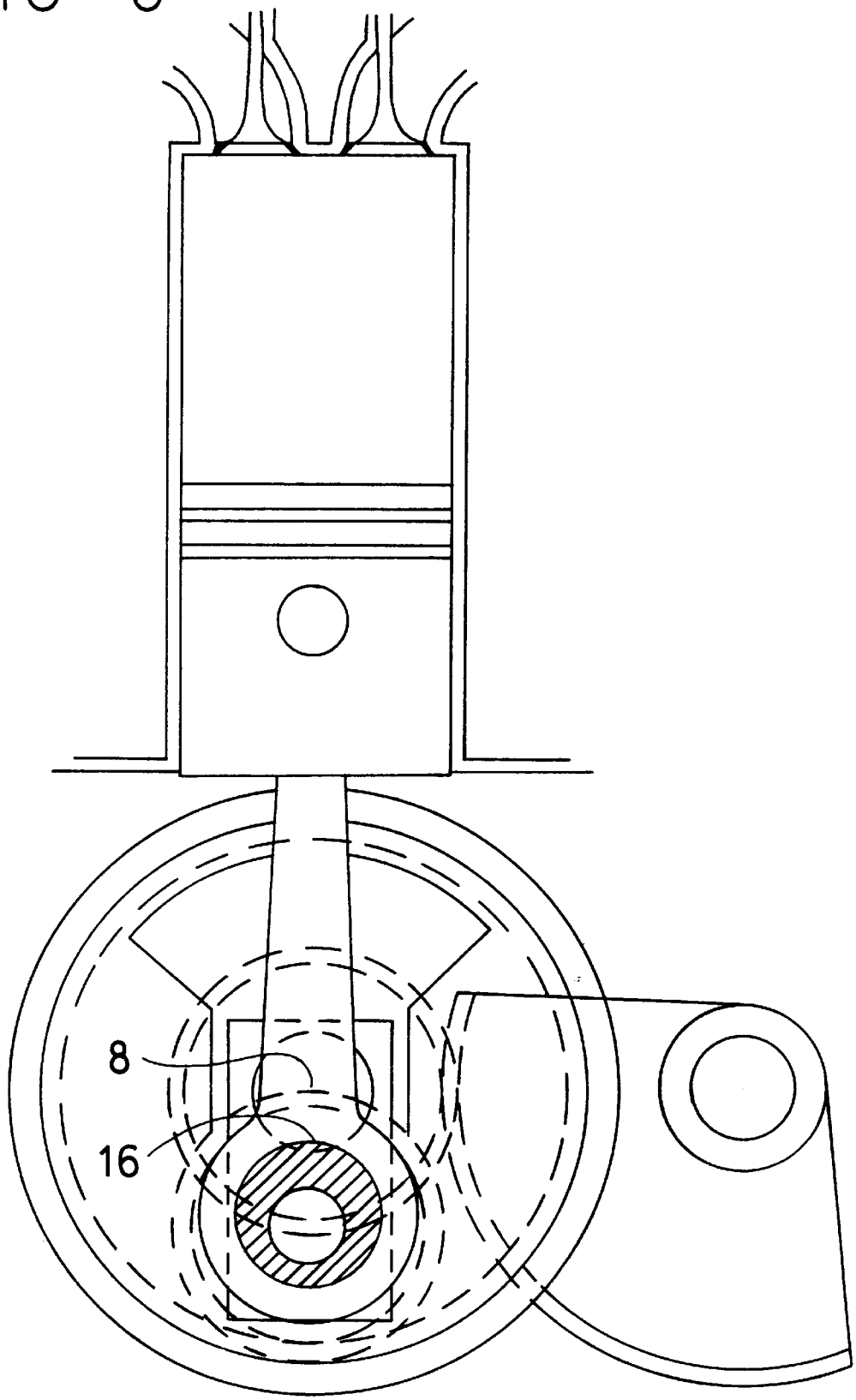
Figure 9:
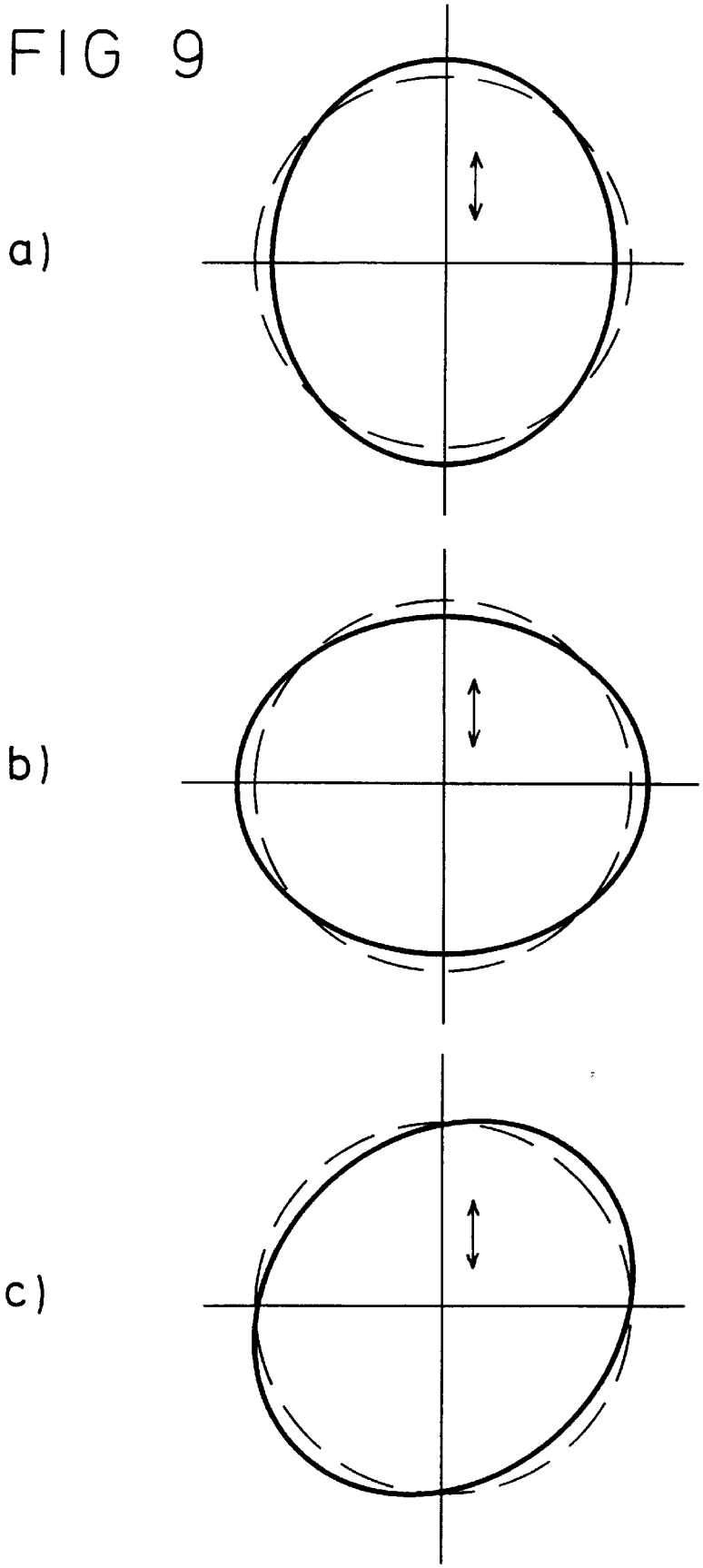
Figure 10:
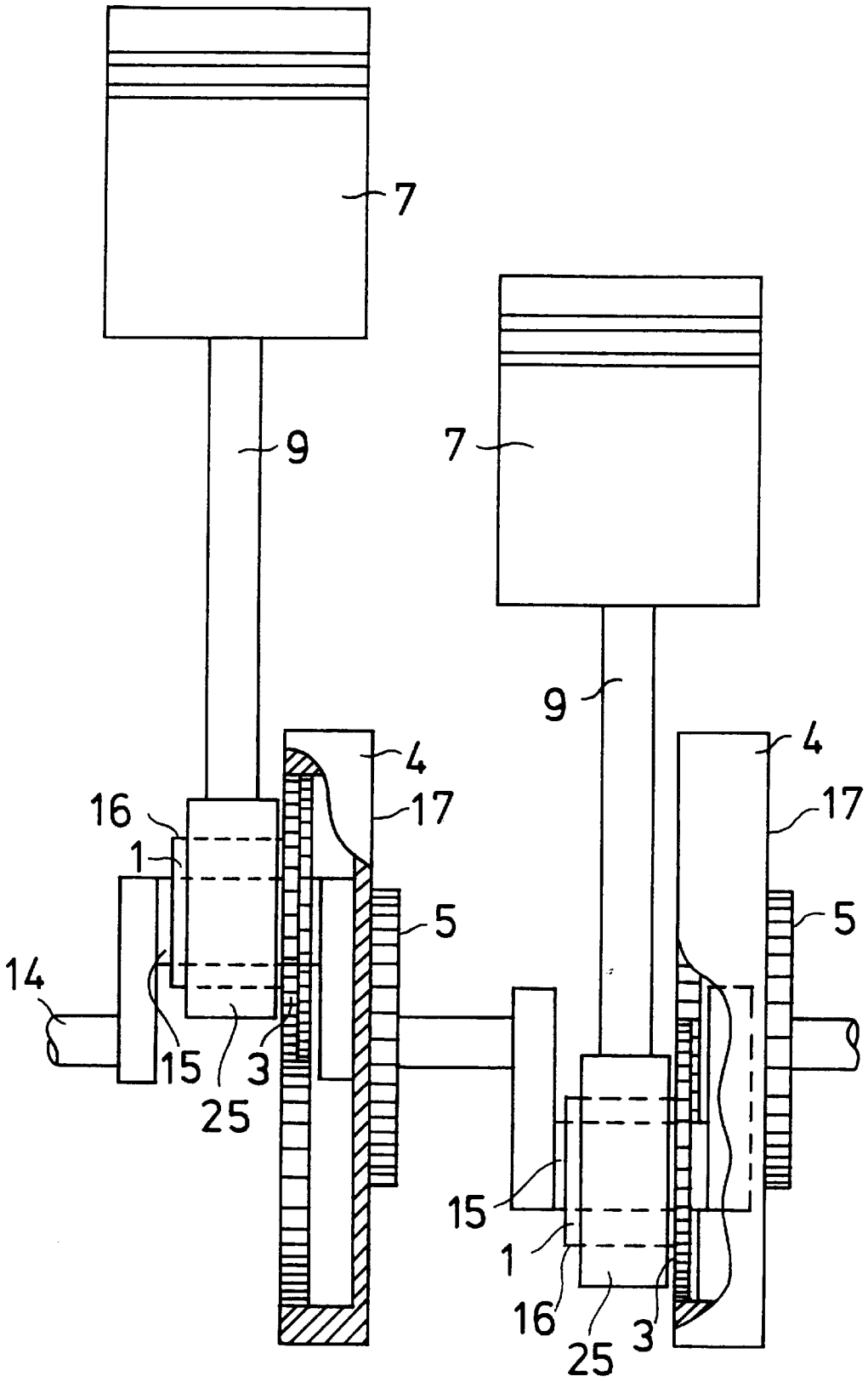
Figure 11:
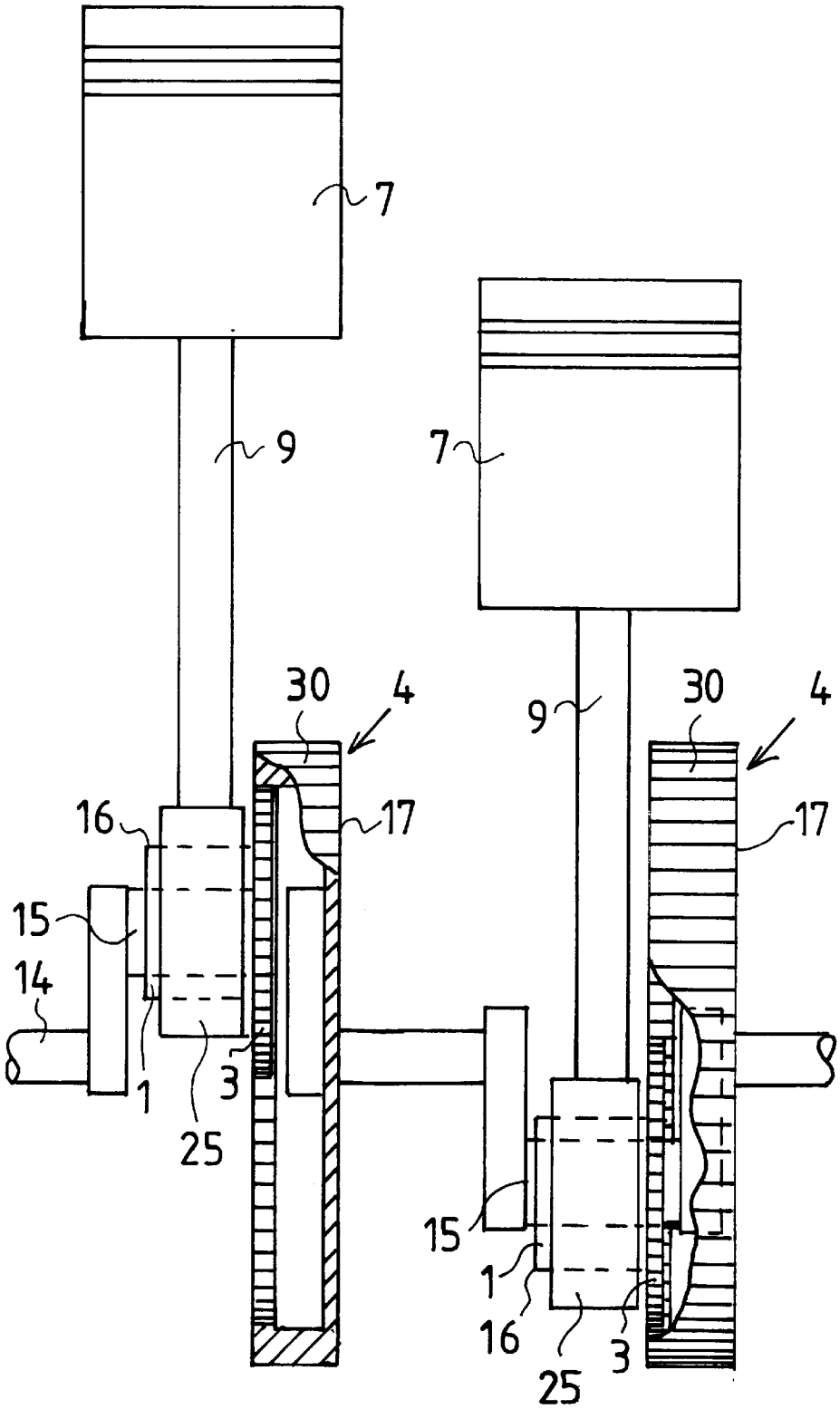

FIG. 1: A basic diagram of the reciprocating piston engine with mechanical regulation of the compression ratio, with the piston at the top dead-centre corresponding to the configuration for the maximum compression ratio;

FIG. 2: A two-part component as toothed gear and eccentric;

FIG. 3: A perspective view of the two-part component;

FIG. 4: The basic diagram with the configuration for the maximum compression ratio, with the piston right in the middle between the top and the bottom dead-centres;

FIG. 5: The basic diagram with the configuration for the maximum compression ratio, with the piston at the bottom dead-centre;

FIG. 6: The basic diagram with the configuration for the minimum compression ratio, with the piston at the top dead-centre;

FIG. 7: The basic diagram with the configuration for the minimum compression ratio, with the piston right in the middle between the top and the bottom dead-centres;

FIG. 8: The basic diagram with the configuration for the minimum compression ratio, with the piston at the bottom dead-centre;

FIG. 9: The elliptic curves which the centre of the eccentrically disposed crank pin traces in line with the different configurations of the compression ratio;

FIG. 10: A side view of the construction for adjusting the compression ratio; and, FIG. 11: A side view of the construction with a toothed periphery of the internal gear.

FIG. 1 is a basic diagram of the internal combustion engine showing, in this case, a single cylinder. There is no problem at all in realizing the overall principle in engines with several cylinders, regardless of whether the cylinders are disposed relative to each other in a row, a V-formation or in a boxer configuration. This Figure shows a cylinder 10 with an inlet valve 11 and an exhaust valve 12 on the cylinder head and the piston 7 which is mounted in the cylinder 10 and is connected to the crankshaft 14 via the connecting rod 9. Number 8 designates the fixed axis of the crankshaft 14. On the crankshaft 14 there is a flyweight 13 which is rigidly connected with the crankshaft 14 and which forms the counterweight to the weight of the crank. The crank itself 25 has a very special crank pin 1. En a conventional engine, the crank pin runs at a right-angle to the plane of rotation of the crank arm and traces a concentric circle when the engine is running. Hence it is always at a defined, and therefore constant, distance to the crankshaft axis 8, i.e. axis 8, which drives the crank. In contrast to this, the crank pin according to the invention is an eccentric 1 in relation to the conventional crank pin axis 2, i.e. in relation to the conventional axis 2 of the crank pin. This eccentric 1 can be rotated around the conventional crank pin axis 2. The crankshaft side end of the connecting rod 9 encloses this eccentric 1 with the connecting rod bearing so that the eccentric 1 can rotate in the connecting rod bearing. In this example, the structural arrangement of this eccentric 1 is solved in that the eccentric crank pin 1 is constituted by two shells 26,27 which are disposed around the crankarm-shaft 15 of the crankshaft 14 so as to enclose it, thereby forming an eccentric crank pin 1. These shells 26,27 are each connected with a toothed gear segment 28,29, which segments 28,29 also enclose the crankarm-shaft 15 of the crankshaft 14. The toothed gear 3 formed by these segments 28,29 rolls as an external gear 3 inside a larger diameter internal gear 4 mounted concentrically around the axis B of the crankshaft 14 such that it can be freely rotated and its rotating position may be adjusted. When the internal gear 4 is stationary, the external gear 3 turns exactly once upon itself every time it rolls round the inside of the internal gear.

FIG. 2 shows this component, which forms the external gear 3 and the eccentric 1 in a) a vertical section and b) a top plan view of the bottom part 27,29 of the component. The toothed gear 3 is round, but cut through the middle into two segments 28,29, which bear the half-shells 26,27 at their front ends, which, when mounted together, form an eccentric 1 in relation to the axis of rotation of the toothed gear 3. These two parts of the component are joined together around the crankshaft axis, i.e. around the conventional crank pin of a crankshaft and the connecting rod is mounted around the eccentric 1 thus formed. The lower connecting rod bearing holds the two parts tightly together.

FIG. 2*b*) shows a top plan view of the bottom part of the component with hatching designating the flat 'cut' surface. The component is made from a suitable hardened steel alloy of the type customarily used for stressed toothed gears. Its inside has a white-metal coating and is hardened and polished to prevent abrasion. This inside runs on the crank pin 15 which is made from a cast steel. The outside of the component, i.e. the outside of shells 26,27 is hard-chrome plated. These outsides of the shells 26,27 are enclosed by the connecting bearing. The connecting rods are usually made from aluminium, in which case the outsides of the shells 26,27 only need to be hard-chrome plated to prevent abrasion.

FIG. 3 shows a perspective view of this two-piece component. The two shells 26,27 and the two toothed gear segments 28,29 can be seen. Placed together, these segments form a circular toothed gear 3 and the shells 26,27 form an eccentric 1 in relation to the axis of the toothed gear. If this toothed gear 3 is rotated, the eccentric 1 also rotates around the toothed gear axis. This moves the bottom connecting rod bearing, which encloses the eccentric 1, and the connecting rod up and down according to the position of the eccentric 1. The point on the eccentric 1 with the biggest radius in relation to its axis of rotation is designated by 16 and forms a sort of nose. In an alternative version, the component could be made not from two parts but from several parts, i.e. three, for example, each of which extend around 120°.

In FIG. 1, the nose 16 formed by the eccentric 1 is directed upwards. In this position the piston 7 therefore moves into the highest possible position and the volume of the combustion chamber is correspondingly small. With the eccentric 1 in this position, compression is at its highest. The toothed gear 3 is designed as an external gear and therefore has a toothed periphery with which it rolls around the inside of the internal gear 4. This internal gear 4 consists of a disk 17 which is rotatably mounted around the crankshaft 14. On the outer edge of the disk there is a projection 18 with toothing 19 around the inside thereof. The toothed gear 3 constitutes the external gear in relation to this toothing 19 and it therefore rolls around the inside edge of this projection 18 along toothing 19, with the teeth 20 of the external gear 3 meshing with those 19 of the internal gear 4 as it does so. The ratio of the periphery of the toothing 19 of the internal gear 4 to that of the external gear 3 is 2:1. Hence the external gear turns once around 360° as it rolls round the entire periphery of the internal gear toothing 19 and, correspondingly, around only 180° when it rolls around only half the periphery of the internal gear toothing 19. In relation to the eccentric 1, which is rigidly connected with the toothed gear 3, this means that, starting from the position shown in FIG. 1 where the nose 16 of the eccentric 1 points upwards and hence compression is at its maximum, the nose 16 changes position as follows when the crankshaft 14 turns through one revolution: the toothed gear 3 as a whole, and the crank pin shaft with it, move e.g. clockwise around the crankshaft 14 whilst the toothed gear 3 itself turns anti-clockwise. After the crankshaft rotates through 90° in this manner, the nose 16 points left towards the crankshaft axis. Hence the toothed gear 3 and the eccentric 1 with it have turned through 90° anti-clockwise. This new situation after such a 90° rotation is shown in FIG. 4. The crank arm 25 is now horizontal and its actual effective length is shortened in comparison with its length in the starting position shown in FIG. 1. After another 90° rotation the crank arm 25 arrives at the bottom and the nose 16 points downwards. This situation is shown in FIG. 5. In this position, the connecting rod 9 and piston 7 are shifted downwards in comparison with a conventional engine. With the engine running, this means that the suction stroke of the piston 7 is also lengthened in comparison with the former construction, which also has a positive effect on the compression ratio. After another 90° rotation, the nose 16 points towards the crankshaft axis again and after yet another 90° rotation, i.e. on completion of a full 360° rotation, it points upwards again as shown in the starting position in FIG. 1. The centre of the eccentric 1 traces the actually effective crank path since the bottom connecting rod bearing encloses the eccentric 1.

As can now be seen in FIG. 1, where the centre of the eccentric 1 is designated by the number 21, this centre 21 is shifted upwards in relation to the axis 2 of the crank pin shaft 15 which is formed by the axis of rotation of the toothed gear 3. Hence the connecting rod 9 which is linked to the eccentric 1 and connected at the top with the piston 7 is raised, and with it, of course, the piston 7 as well. Thus the piston 7 adopts a raised positioned in its top dead-centre as shown in FIG. 1. Correspondingly higher compression is achieved. Conversely, the bottom dead-centre of the piston 7 is shifted downwards to the same degree by the downwardly pointing nose 16 of the eccentric 1 as shown in FIG. 5, which, as already mentioned, allows a longer suction stroke and increases the compression ratio again. As regards the effective crank arm length, the latter adopts an intermediate value in the intermediate positions, e.g. in the position shown in FIG. 4. Hence the crank arm length attains a maximum at the top dead-centre of the piston 7, then moves to a minimum after one 90° rotation, and then reattains a maximum towards the bottom dead-centre. It then goes through the same variations as the piston 7 returns to its top dead-centre. Thus the crank no longer traces a circle, but a vertical ellipse.

This internal combustion engine can now provide varing compression ratios. For this purpose the toothed gear 3 is rotated with the eccentric 1 around the axis 2 of the crank pin shaft 15. This is achieved by rotating the internal gear 4 around the crankshaft. FIG. 6 shows the other extreme position in which the nose 16 on the eccentric 1 points downwards in the top position of the piston 7, i.e. at its top dead-centre. In this configuration, the volume of the combustion chamber is at a maximum. If the external gear 3 now rolls from this starting position in the same manner round the toothed periphery 19 of the internal gear 4, the eccentric 1 initially moves into the intermediate position shown in FIG. 7 when the crankshaft rotates clockwise through 90°. Here, the nose 16 points radially outwards in relation to the crankshaft axis 8 and hence the effective crank arm attains its maximum length. At the bottom dead-centre of the piston 7, as shown in FIG. 8, the nose 16 moves into a position where it points upwards, i.e. towards the crankshaft axis 8. In this compression configuration the piston 7 has a minimal stroke. The suction path is minimal, the volume of combustion chamber is maximum and hence the compression ratio is at its minimum. The crank traces a horizontal ellipse. The compression ratio can be freely selected by adjusting the eccentric 1 in the range between the two maximum positions described. In the intermediate configurations the crank always traces a uniform ellipse although the latter is then neither vertical nor horizontal, but obliquely angled in relation to the direction of the piston's motion.

FIG. 9 shows the different curves described by the centre of the eccentric 1 in the various configurations. The piston moves in the directions indicated by the arrows. FIG. 9*a*) shows the configuration for the maximum compression ratio. Here the crank traces a vertical ellipse. By way of comparison, the path of the crank in a conventional engine is indicated by a dashed line. In this configuration the piston path is longer. Both the suction path and the compression path are longer and the volume of the compression space is reduced simultaneously. The compression ratio is at its maximum in this configuration. Since engine efficiency increases as compression increases, with the increase being greatest in the case of small loads, this configuration is used in petrol engines somewhere in the partial load range, whilst the compression ratio is reduced somewhat under a full load. For diesel engines, it is advantageous to set the maximum compression ratio for starting the engine and then reduce it for operating the engine.

FIG. 9*b*) shows the curve described by the centre of the eccentric 1 in the configuration for the minimum compression ratio. The crank pin traces an identical ellipse, except for the fact that it is horizontal. The piston path is at its minimum, i.e. both the suction path and the compression path are at their minimum. At the same time, the downwardly shifted top dead-centre enlarges the volume of the combustion chamber. Hence the compression ratio is at a minimum in this configuration. The configuration is suitable for when the engine is running idle, for example.

FIG. 9*c*) shows the curve traced by the centre of the eccentric 1 in an intermediate configuration. The effective crank pin again traces the same ellipse, but the latter is now obliquely angled in relation to the direction of the piston's motion. Depending on the direction of rotation, the eccentric 1, resp. the nose 16 it forms, can either be turned to the left or the right. As regards the ellipse shown where, the desired engine characteristics will dictate whether the engine should run clockwise or anti-clockwise. Clockwise motion is likely to be advantageous as this prolongs the compression for as long as possible so that combustion can proceed under optimum conditions and the combustion pressure can develop in the most efficient manner, i.e. with the crank length at a maximum but declining as the rotation proceeds.

The actual adjustment of the eccentric 1 is achieved by rotating the toothed gear 3 by means of the internal gear 4. To rotate the eccentric 1 by 180° from one maximum position to the other, the internal gear 4 has to be rotated around the crankshaft axis 8 by a quarter-rotation. This rotation of the internal gear 4 can be produced by various adjusting means. An example is shown in FIGS. 1, 4 to 8 and 10. On the flat outside of the disk 17 furthest away from the projection the internal gear 4 is rigidly connected to a concentric toothed gear 5 which acts as a spur gear. The toothing 23 of a toothed control gear 6, which rotates around a shaft 24 arranged at the side, meshes with the toothing 22 indicated in FIG. 1 around the periphery of this spur gear 5. Since, as shown here, the radius of the toothed control gear 6 is more than double that of the spur gear 5, the toothed control gear only has to be rotated by about 40° to make the adjustment from one maximum position to the other. In the case of several cylinders arranged in a row, several such toothed control gears are mounted on a common side-shaft 24. In a V-formation engine, a central shaft from which the internal gears 4 to each cylinder are operated can be disposed between the V-arms. A similar arrangement is also possible for a boxer engine so that the same side-shaft controls the internal gears to the respective opposite cylinders. The control gear 6 can be operated in a variety of ways. One conceivable option, for example, is to drive it by means of a servomotor in the form of an electric stepping motor which acts directly or indirectly on the side-shaft 24, e.g. by means of a toothed belt or a pinion, and with which a rapid adjustment from one maximum configuration to another can be achieved. This stepping motor is advantageously controlled by a microprocessor. The microprocessor used to control the process can be electronically fed with a plurality of parameters. The engine load, for example, can be measured electronically at the gearbox, in exactly the same way as such data is now measured anyway for controlling the gear change mechanism in many automatic gearboxes. The engine speed—a crucial parameter—can also be electronically detected and taken account of in regulating the compression ratio. The signals from a knocking sensor, a device which is already built into many modern vehicles, can also be processed. The combustion pressure and combustion temperature can also be measured and taken into account. Finally, with the aid of multidimensional performance characteristics all these data are then processed by such a microprocessor into an output signal which prompts the stepping motor to change the position of the control gear(s).

FIG. 10 shows a side view of the engine with an illustration of two pistons 7 with their crank drives. As already described, the construction for varying the compression ratio includes an internal gear 4 sitting on the crankshaft 14, said internal gear being mounted on the crankshaft 14 such that it is free-running. For the sake of clarity, these internal gears 4 are shown here as partial sections. The flat outside of the disk 17 furthest away from the projection concentrically supports a toothed gear 5 that is rigidly connected with it. A toothed gear 3, that is rigidly connected with an eccentric 1, runs around the toothed inside projection of the internal gear 4. This eccentric 1 encloses the crankarm-shaft 15 and is mounted on it such that it can rotate freely. The bottom connecting rod bearing 25 of the connecting rod 9 encloses the eccentric 1 whose nose 16 points upwards in the case of the left piston 7 and downwards in the case of the right piston 7. The left piston 7 is accordingly raised somewhat and the right one is somewhat lower. If the toothed gear 5 is turned with the internal gear 4, the eccentric 1 also rotates in a fixed position so that the nose 16 it forms changes position. With the engine running, the toothed gear 3 rolls as an external gear round the inside of the internal gear 4, causing the eccentric 1 to rotate around exactly 360° as the crankshaft rotates once. Thus, when the crankshaft rotates through 180°, the eccentric 1 also rotates through 180° and the nose 16 it forms then points downwards as can be seen in the crankshaft section shown on the right. Because the nose 16 points downwards there, the bottom piston position is lowered. This results overall in a bigger piston stroke and the volume of the combustion chamber is naturally reduced at the same time. The compression ratio is increased. The effective crank arm is shorter in the intermediate positions. The actually effective centre of the crank pin traces a vertical ellipse when the compression is high.

As an alternative, the internal gear 4 can be provided with toothing along its outer periphery to allow it to be moved by means of a toothed gear which meshes directly in this toothing. When the compression is set to a certain configuration the internal gear remains stationary while the engine is running. It is also conceivable to allow the internal gear to run with the crankshaft. In this case the rotating position of the eccentric would always remain the same throughout a revolution so that the effective crank arm length would always remain the same throughout the entire revolution. Accordingly, the centre of the eccentric would no longer trace an ellipse, but a circle. The adjustment would then have to be made by changing the rotating position of the internal gear in relation to the axis of the crank.

By varying the compression ratio, the engine according to the invention makes it possible to take account of one other important parameter with a decisive impact on the characteristics and performance of an engine. The modification can be made to existing engines, with only the crankshafts and, in certain cases, the engine blocks having to be adapted for a new production series, i.e. a complete reconstruction of the engine is not required. In many cases the existing engine block can even be reused if there is enough space for disposing the toothed gears and the side-shaft. Hence the cylinders, pistons, connecting rods and peripheral engine components such as the ignition/fuel injection mechanisms and the auxiliary systems are not in principle affected by this modification. An internal combustion engine with variable compression promises to perform significantly better whilst running more smoothly and ensuring increased optimization of fuel consumption due to the improvement in engine efficiency, with a further reduction in the volume of exhaust emissions as a consequence of the optimized combustion process.

What is claimed is:

1. Reciprocating piston type internal combustion engine with a variable compression ratio in that the piston hub may be adjusted because the connecting rod is mounted on the crankshaft side on an eccentric crank pin with the eccentric crank pin being able to be adjusted around its axis of rotation by control means while the engine is running, in which the eccentric crank pin is formed by at least two shells which are arranged around the crankarm-shaft of the crankshaft so as to enclose it, and in that these shells are each connected with a toothed gear segment, said segments also enclosing the crankarm-shaft of the crankshaft, and in that the toothed gear formed by these segments acts as an external gear inside a larger diameter internal gear inside which it rolls, said internal gear being rotatably concentrically mounted around the axis of the crankshaft and its rotating position may be adjusted such that the external gear turns exactly once upon itself every time it rolls round the internal gear when the latter remains stationary.

2. The internal combustion engine of claim 1, wherein the internal gear is concentrically connected on its flat outside with a spur gear which can be adjusted by another toothed control gear which meshes with this spur gear.

3. The internal combustion engine of claim 1, wherein the internal gear has toothing around its outer periphery and can be adjusted by means of a toothed control gear (6) which meshes directly with this toothing.

4. The internal combustion engine of claim 2 wherein the toothed control gear can be turned by means of a separate servomotor and hence the compression ratio of the engine can be varied by changing the crank length, with the servomotor being controlled by a microprocessor in which at least one measured engine operating parameter can be electronically processed.

5. The internal combustion engine of claim 4, wherein the servomotor is an electric stepping motor which drives the toothed control gear via a pinion.

6. The internal combustion engine of claim 4, wherein the servomotor is an electric stepping motor which drives the toothed control gear or its drive axis via a toothed belt.

7. The internal combustion engine of claim 4 wherein there is a microprocessor which is fed with one or several signals indicating the engine load measured in the gearbox, the measured engine speed, the quantity of air sucked or taken in and the signal from a knocking sensor, with which these values can be electronically processed into a control signal for the servomotor.

8. The internal combustion engine of claim 2 wherein in the case of an engine with several cylinders, the toothed control gears are rigidly disposed on a common side-shaft in relation to the individual cylinders.

9. The internal combustion engine of claim 2 wherein the toothed control gear has a radius which is more than double that of the spur gear.

10. The internal combustion engine of claim 1 wherein the internal gear is designed to run with the crankshaft, but its rotating position relative to the crankshaft can be adjusted such that the effective crank arm length is always the same throughout the full crank revolution.

* * * * *